US007282674B2

(12) United States Patent
Hansen et al.

(10) Patent No.: US 7,282,674 B2
(45) Date of Patent: Oct. 16, 2007

(54) SYSTEM AND METHOD FOR LIMITING THE ESCAPE OF HEAT AND STEAM FROM AN OPEN OVEN DOOR

(75) Inventors: William J. Hansen, Pewaukee, WI (US); Janus W. Bartelick, Germantown, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 30 days.

(21) Appl. No.: 11/356,888

(22) Filed: Feb. 17, 2006

(65) Prior Publication Data

US 2007/0194004 A1 Aug. 23, 2007

(51) Int. Cl.
*F27D 11/00* (2006.01)
*F23M 7/00* (2006.01)

(52) U.S. Cl. ..... 219/401; 219/391; 219/402; 219/400; 126/190; 126/193; 126/199 R; 126/200; 422/177; 99/332

(58) Field of Classification Search ..... 219/391, 219/401, 402, 400; 126/190, 193, 199 R, 126/200; 422/177; 97/332
See application file for complete search history.

(56) References Cited

U.S. PATENT DOCUMENTS

| | | | | |
|---|---|---|---|---|
| 4,113,439 | A | 9/1978 | Ookubo et al. | |
| 5,425,393 | A | 6/1995 | Everett | |
| 5,525,782 | A * | 6/1996 | Yoneno et al. | 219/682 |
| 5,631,033 | A | 5/1997 | Kolvites | |
| 7,143,761 | B2 | 12/2006 | Hwang | |
| 7,238,922 | B2 | 7/2007 | Andoh et al. | |
| 2003/0178411 | A1 | 9/2003 | Manganiello et al. | |
| 2004/0255925 | A1 | 12/2004 | Smits et al. | |

* cited by examiner

*Primary Examiner*—Shawntina Fuqua
(74) *Attorney, Agent, or Firm*—Quarles & Brady

(57) ABSTRACT

A system for reducing discharges from an oven prior to opening an oven door. In particular, the system includes a housing forming a cooking compartment arranged within the oven. The system also includes a purge passage extending through the housing into the cooking compartment and a cover arranged over a portion of the purge passage to removeably block the purge passage. An expelling port is included that extends from the cooking compartment through the housing. A controller is configured to remove the cover from blocking the purge passage to inject air into the cooking compartment through the purge passage and displace substances within the cooking compartment through the expelling port.

28 Claims, 3 Drawing Sheets

SYSTEM AND METHOD FOR LIMITING THE ESCAPE OF HEAT AND STEAM FROM AN OPEN OVEN DOOR

CROSS-REFERENCE TO RELATED APPLICATIONS

--

STATEMENT REGARDING FEDERALLY SPONSORED RESEARCH OR DEVELOPMENT

--

BACKGROUND OF THE INVENTION

The present invention relates generally to a system and method for reducing discharges from an oven and, more particularly, to a system and method for venting combination convection and steam ovens prior to the expiration of a cooking time.

Combination ovens provide the ability to cook foods using steam, hot-air convection, or both steam and convection. A motor driven fan is used to circulate air within a cooking chamber past electrical heating elements or gas heat exchange tubes to perform the convection functionality. To produce steam within the cooking chamber, a water line feeds water into the cooking chamber near the heating elements to vaporize the water.

This combination of convection heating with steam provides a system where food can be properly cooked significantly faster than with traditional ovens or even convection ovens alone. As a result, combination ovens have become a vital asset in commercial cooking environments that need to cook food quickly and, often, in large quantities.

Within any kitchen employing even traditional ovens, the heat produced by the oven can significantly affect the temperature of the kitchen, especially when the oven door is opened. In the case of combination ovens, the steam released upon opening the oven door may further raise the temperature in the kitchen. Furthermore, even if the kitchen is of sufficient size to allow the heat and steam to dissipate, the individual operating the combination oven is subjected to a concentrated release of heat and steam upon each opening of the oven door. In either case, this can present a less than desirable working condition, especially in commercial kitchens where one or more combination ovens are routinely used over long durations requiring repetitive openings and closings of the oven door.

Accordingly, it would be desirable to have a system and method to manage the discharge of steam and/or other substances from an oven upon opening of the oven door.

SUMMARY OF THE INVENTION

The present invention overcomes the aforementioned drawbacks by providing a system and method for reducing a steam level within an oven prior to the expiration of a cooking period. In particular, a controller is configured to open a passage formed in the oven to inject cool air into the oven prior to the expiration of a cooking period. A exhaust port is included through which heated air and steam can escape as they are displaced by the cool air entering through the oven.

In accordance with one aspect of the invention, a system for reducing a steam discharge from an oven is disclosed that includes a housing forming a cooking compartment arranged within the oven. The system also includes a purge passage extending through the housing into the cooking compartment, a cover arranged over a portion of the purge passage to removeably block the purge passage, and an expelling port extending from the cooking compartment through the housing. A controller is configured to remove the cover from blocking the purge passage to inject air into the cooking compartment through the purge passage and displace steam within the cooking compartment through the expelling port.

In accordance with another aspect of the invention, a system for reducing a steam discharge from an oven is disclosed that includes a cooking compartment arranged within the oven. The system also includes a purge passage extending through the oven into the cooking compartment and a cover arranged to removeably block the purge passage. A controller is configured to receive a cooking time and automatically move the cover to expose the purge passage prior to expiration of the cooking time to substantially purge the cooking compartment of steam.

In accordance with yet another aspect of the invention, a method of operating an oven is disclosed that includes setting a user-selected cooking time and automatically opening a purge passage formed in the oven to induce air external from the oven to enter the oven and substantially purge the oven of steam prior to the expiration of the user-selected cooking time.

Various other features of the present invention will be made apparent from the following detailed description and the drawings.

DETAILED DESCRIPTION OF THE INVENTION

Figure 1:
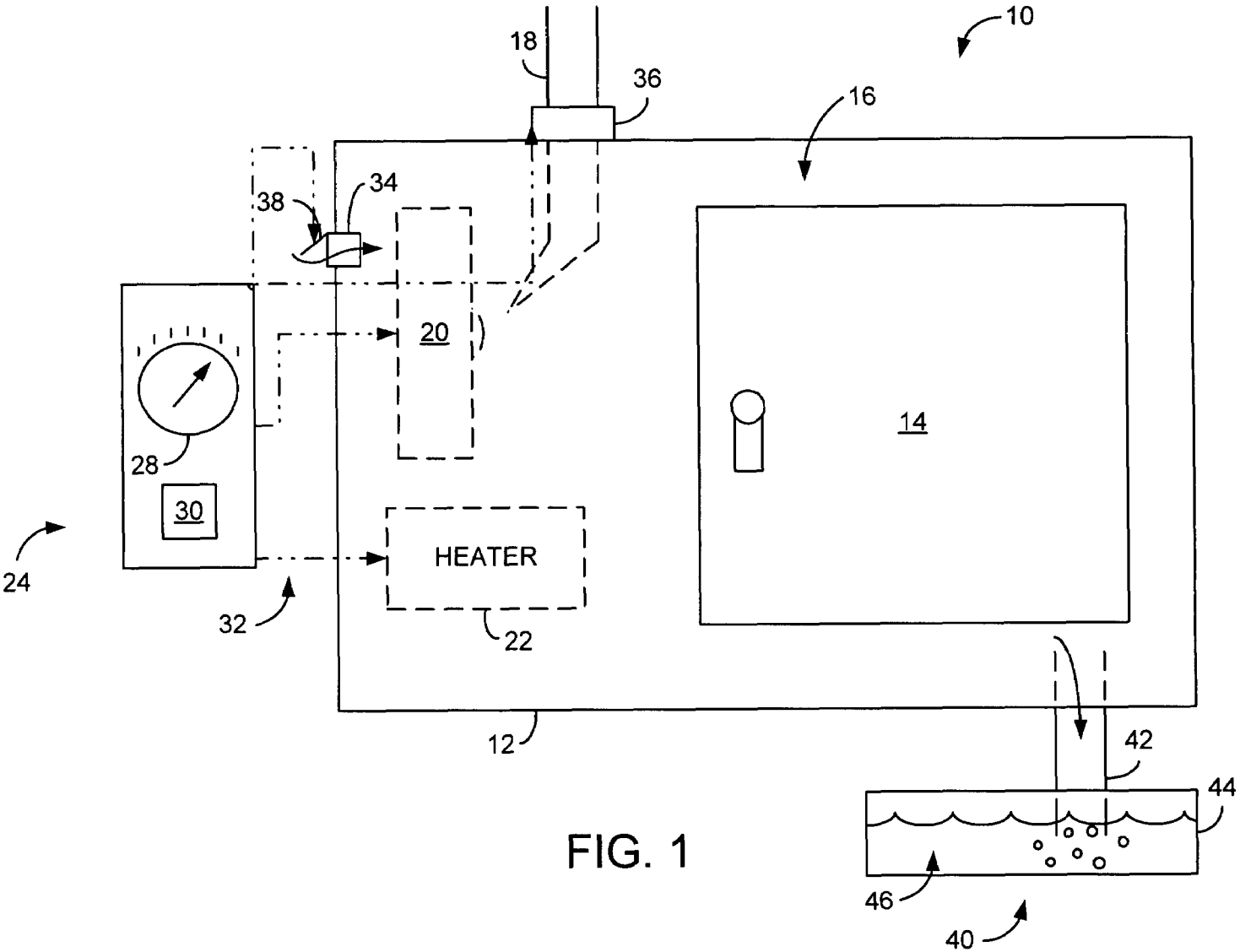
FIG. 1 is a front view of combination oven including a purging system according to the present invention.

Referring now to FIG. 1, a combination oven 10 may include a generally rectangular housing 12 providing an oven door 114 through which food may be placed into a cooking compartment 16. As is common in combination ovens, a water line 18 is included that injects water toward a fan 20 so that the water impinges upon the fan 20. By contacting the fan 20, the water is separated into small droplets providing a larger overall surface area which can be vaporized more efficiently by a heater 22. In this regard, the heater 22 serves the dual purpose of heating the cooking compartment 16 of the combination oven 10 as well as evaporating the water injected into cooking compartment 16 to generate the steam necessary to function as a steamer. Similarly, the fan 20 serves the dual purpose of atomizing the water injected into the cooking compartment 16 as well as circulating the heat produced by the heater 22 to function as a convection oven.

The combination oven 10 also includes a purging system 24. The purging system 24 includes a controller 26 having a timer 28 and an indicator 30. The indicator 30 may be an audible indicator or a visual indicator, or even a combination thereof. Optionally, a purge button (not shown) could be included that allows manually initiation of the purging process described below. Furthermore, the indicator 30, as will be described, may be configured to indicate an expiration of a cooking time, initiation of a purge period, or both.

The controller 26 is connected through a plurality of control lines 32 to the heater 22, the fan 20, a purge passage 34, and the water supply line 18. In particular, the controller 26 communicates with a valve 36 disposed along the water supply line 18 and a cover 38 disposed over purge passage 34.

The combination oven 10 also includes a condensing system 40. The condensing system 40 includes a condensing outlet 42 that extends from the cooking compartment 16 of the combination oven 10 into a condensing reservoir 44 having a condensing liquid 46, preferably water, dispose therein. Therefore, during operation of the combination oven 10, the condensing outlet 42 serves as a passage for excess steam as well as condensation formed within the cooking compartment 16 to be released into the condensing reservoir 44. In this regard, the condensing liquid 46 cools and collects steam and/or grease as well as any odors associated therewith.

Figure 2:
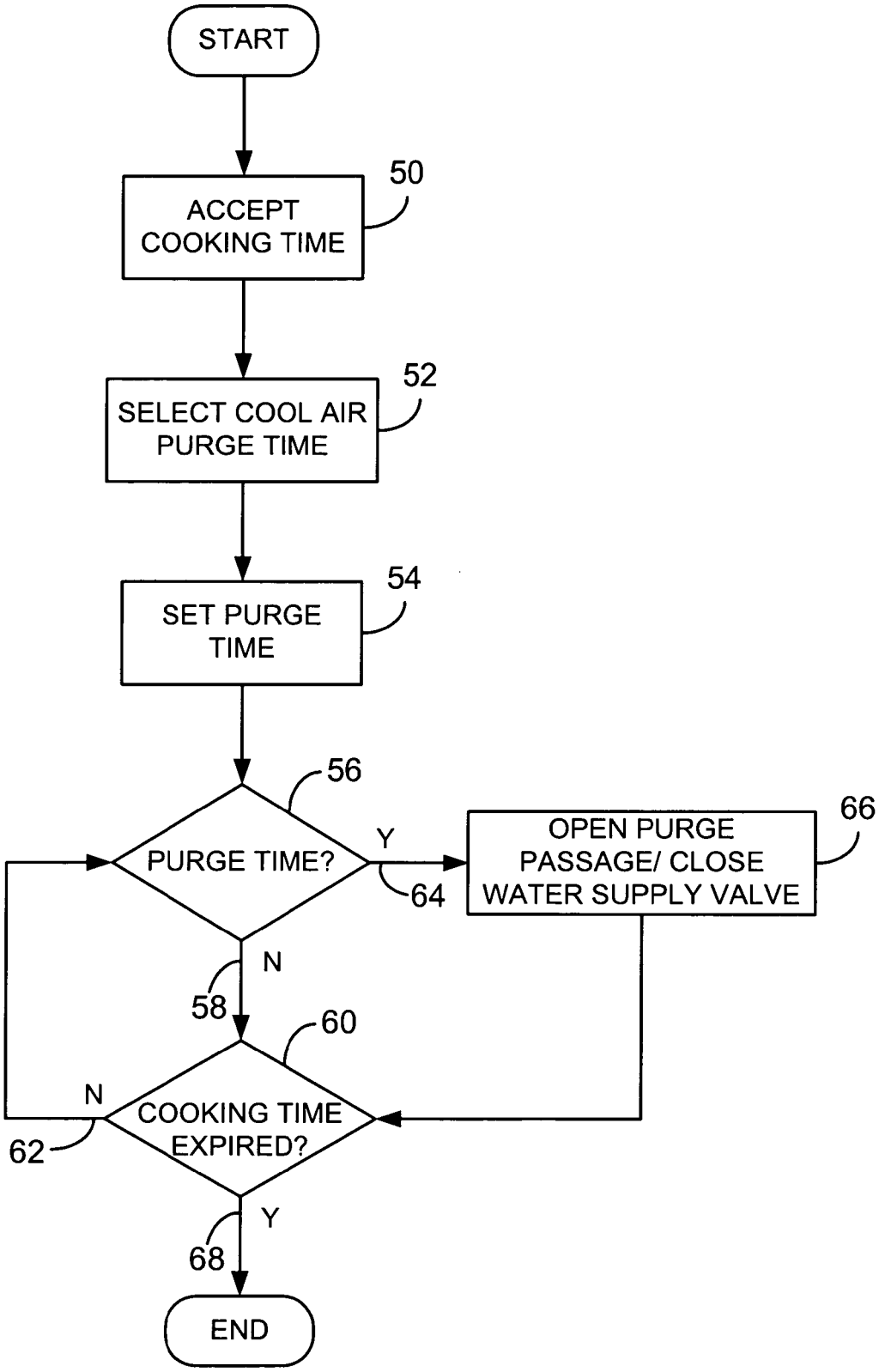
FIG. 2 is a flow chart setting forth the steps of a purging process performed using the combination oven and purging system of FIG. 1.

Referring now to FIGS. 1 and 2, operation of the combination oven 10 starts at process block 50 upon entry of a cooling time. In particular, the purging system 24 is configured to accept the cooking time via the timer 28 indicating the duration for which a user wishes food placed within the cooking compartment to be heated and steamed. Following at process block 52, the controller 26 automatically selects a purging time within the duration of the cooking time. For example, the purging time may be set at a fixed interval prior to the expiration of the selected cooking time, or may be automatically calculated by the controller 26 based on the temperature and/or duration of the selected cooking time such that it is dynamically positioned at an optimal time prior to the expiration of the selected cooking time.

Continuing at process block 54, once the purge time has been set, cooking is initiated by energizing the heater 22 and the fan 20 and by injecting water via the water supply line 18. Accordingly, initialization of a cooking procedure is controlled by the controller 26 utilizing control lines 32. It should be noted that at the outset of the desired cooking process the cover 38 over the purge passage 34 is in a closed position completely covering purge passage 34.

As the cooking process progresses to decision block 56, the controller 26 continually determines whether the purge time selected at process block 52 has been reached. If the purged time has not yet been reached 58, the controller 26 determines whether the cooking time has expired at decision block 60. However, if the purge time has not yet expired, preferably, the cooking time has not yet expired 62. Therefore, the controller 26 continues to cycle through decision blocks 56 and 60 by checking whether the purge time or the cooking time has expired until the purge time is reached 64.

Once the purge time has been reached 64, the controller 26 automatically opens the cover 38 over the purge passage 34 at process block 66. Alternatively, a purge button could be included to allow an operator to open the cover 38 once the purge time has been reached 64. Additionally, such a purge button could be combined with the automatic opening ability for the controller 26 to allow an operator to open the cover 38 whenever desired. In either case, cool air from the exterior from the combination oven 10 is injected into the cooking chamber 16. Simultaneously with opening the cover 32 or, alternatively, just prior thereto, the controller 26 closes the valve 36 to discontinue the supply of water delivered by the water supply line 18 into the cooking chamber 16. That is, the controller 26 is configured to close the valve 36 to discontinue the supply of water injected into the cooking chamber substantially contemporaneously with opening the cover 32 to expose the purge passage 34. In this regard, the generation of steam within the cooking chamber 16 is discontinued prior to or along with opening the cover over purge passage 34. Additionally, it is contemplated that the heater 22 may be disengaged along with the closing of valve 36 so that the cool air entering the cooking chamber 16 through the purge passage 34 can substantially cool the cooking chamber 16. However, in many applications, it may be preferable to allow the heater 22 to continue to operate so that the cooking chamber remains at a substantially consistent temperature in order to avoid cooling the food being cooked within the cooking chamber 16, even though cool air is entering the cooking chamber through the purge passage 34.

In either case, upon opening the purge passage 34 cool air enters the cooking chamber 16 and is aided by the fan 20 to advance across the cooking chamber. In this regard, the steam previously filling the cooking chamber 16 is pushed towards the condensing outlet 42 and into the condensing reservoir 44. Therefore, upon the expiration of the cooking time 68, the cooking chamber 16 is substantially free of steam. As such, when the indicator 30 signals the expiration of the cooking time, a user may open the oven door 14 without expelling substantial amounts of steam.

Figure 3:
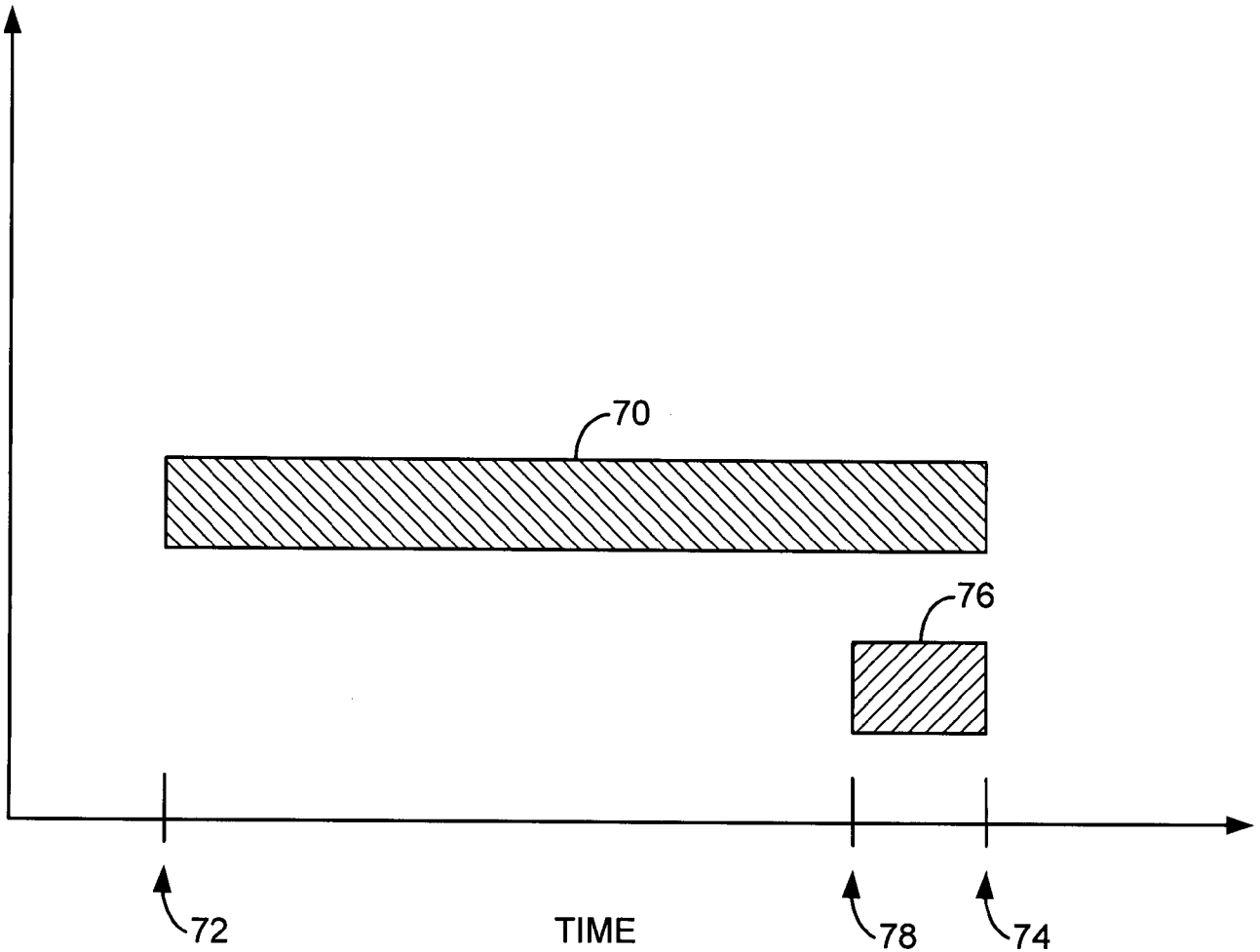
FIG. 3 is a graph illustrating an operational timeline for the combination oven and purging system of FIG. 1 when operated according to the purging process of FIG. 2.

Referring now to FIG. 3, when a user enters a cooking time 70 of a duration extending from a start time 72 to an end time 74, as described above, the controller calculates a purge period 76. However, rather than extending beyond the end time 74 of the cooking time 70, a purge time 78 is selected such that the cooking time 70 and the purge period 76 expire at the end time 74. Therefore, according to the system and method described above, the controller is configured to receive a cooking time and automatically move the cover to expose the purge passage at the purge time 78 prior to the expiration of the cooking time 70 that was selected to substantially purge the cooking compartment of steam by the end time 74.

Therefore, a system and method is provided for reducing a steam level within an oven prior to an expiration of a desired cooking time. Specifically, a controller is configured to open a passage formed in the oven to inject cool air into the oven prior to expiration of the cooking period. An exhaust port is provided through which steam can escape as it is displaced by the cool entering the oven.

It should be recognized that while the present invention has been described with respect to the discharge of steam from a combination oven, it is also applicable to other cooking systems to purge steam or other substances from an oven. For example, the above-described system and method could be utilized to purge certain odors and the like prior to opening an oven door.

It is specifically intended that the present invention not be limited to the embodiments and illustrations contained herein, but include modified forms of those embodiments including portions of the embodiments and combinations of elements of different embodiments as come within the scope of the following claims.

We claim:

1. A system for reducing a steam discharge from an oven comprising:

a housing forming a cooking compartment arranged within the oven;

an oven door engaged with the housing to provide access to the cooking compartment;

a purge passage extending through the housing into the cooking compartment;

an expelling port extending from the cooking compartment through the housing;

a controller configured to control airflow through the purge passage and into the cooking compartment to displace steam within the cooking compartment through the expelling port;

a water supply configured to inject water into the cooking compartment;

a valve configured to control a flow of water injected into the cooking compartment; and wherein the controller is further configured to control the valve to discontinue the flow of water injected into the cooking compartment contemporaneously with removing the cover from blocking the purge passage.

2. The system of claim 1 wherein the controller is further configured to substantially purge the cooking compartment of steam prior to opening of the oven door.

3. The system of claim 1 further comprising a cover arranged over a portion of the purge passage to removeably block the purge passage and wherein the controller is further configured to receive a cooking time from a user and remove the cover from blocking the purge passage automatically at a time based on the cooking time to substantially purge the cooking compartment of steam prior to expiration of the cooking time.

4. The system of claim 1 further comprising a reservoir configured to receive steam displaced through the expelling port and condense the steam into a liquid.

5. The system of claim 1 further comprising a fan arranged within the cooking compartment and proximate to the purge passage to propel the air injected into the cooking compartment through the purge passage through the cooking compartment.

6. The system of claim 1 wherein the oven is a combination oven and steamer.

7. A system for reducing a steam discharge from an oven comprising:

a cooking compartment arranged within the oven;

a purge passage extending through the oven into the cooking compartment;

a cover arranged to removeably block the purge passage;

a controller configured to receive a cooking time and automatically move the cover to expose the purge passage prior to expiration of the cooking time to substantially purge the cooking compartment of steam; and a heater configured to heat the cooking chamber during a cooking process and wherein the controller is further configured to disable the heater substantially simultaneously with exposing the purge passage.

8. The system of claim 7 further comprising a condenser outlet extending from the cooking compartment to a condenser and wherein, upon exposing the purge passage, steam within the cooking compartment is forced through the condenser outlet and into the condenser.

9. The system of claim 8 wherein the condenser includes a liquid reservoir extending above an end of the condensation outlet to receive steam forced from the cooking compartment.

10. The system of claim 7 further comprising a water supply configured to inject water into the cooking compartment during a cooking process and wherein the controller is further configured to control the water supply to cease injecting water into the cooking compartment at least one of prior to exposing the purge passage and substantially simultaneously with exposing the purge passage.

11. The system of claim 7 further comprising an alarm configured to provide at least one of a visual and an audio alarm upon exposing the purge passage.

12. The system of claim 7 further comprising a fan disposed within the cooking compartment and aligned with the purge passage to pull air through the purge passage and into the cooking chamber when the purge passage is exposed.

13. The system of claim 7 further comprising a heater configured to heat the cooking chamber during a cooking process and wherein the controller is further configured to disable the heater substantially simultaneously with the expiration of the cooking time.

14. The system of claim 7 further comprising a push button configured to allow the cover to be manually moved.

15. A method of operating an oven having an oven door comprising:

setting a user-selected cooking time;

calculating a cooling time required to substantially purge the oven of steam prior to the expiration of the cooking time and setting a purge timer configured to expire prior to the cooking time by an amount at least to equal the cooling time; and automatically opening a purge passage formed in the oven to induce air external from the oven to enter the oven and substantially purge the oven of steam prior to the expiration of the user-selected cooking time.

16. The method of claim 15 further comprising providing at least one of an auditory and a visual alert substantially simultaneously with opening the purge passage.

17. A system for reducing a steam discharge from an oven comprising:

a cooking compartment arranged within the oven;

a purge passage extending through the oven into the cooking compartment;

a cover arranged to removeably block the purge passage;

a controller configured to receive a cooking time and automatically move the cover to expose the purge passage prior to expiration of the cooking time to substantially purge the cooking compartment of steam; and a water supply configured to inject water into the cooking compartment during a cooking process and wherein the controller is further configured to control the water supply to cease injecting water into the cooking compartment at least one of prior to exposing the purge passage and substantially simultaneously with exposing the purge passage.

18. A system for reducing a steam discharge from an oven comprising:

a cooking compartment arranged within the oven;

a purge passage extending through the oven into the cooking compartment;

a cover arranged to removeably block the purge passage;

a controller configured to receive a cooking time and automatically move the cover to expose the purge passage prior to expiration of the cooking time to substantially purge the cooking compartment of steam; and an alarm configured to provide at least one of a visual and an audio alarm upon exposing the purge passage.

19. The system of claim 18 further comprising a water supply configured to inject water into the cooking compartment during a cooking process and wherein the controller is further configured to control the water supply to cease injecting water into the cooking compartment at least one of prior to exposing the purge passage and substantially simultaneously with exposing the purge passage.

20. The system of claim 18 further comprising a heater configured to heat the cooking chamber during a cooking process and wherein the controller is further configured to disable the heater substantially simultaneously with exposing the purge passage.

21. A system for reducing a steam discharge from an oven comprising:

a cooking compartment arranged within the oven;

a purge passage extending through the oven into the cooking compartment;

a cover arranged to removeably block the purge passage;

a controller configured to receive a cooking time and automatically move the cover to expose the purge passage prior to expiration of the cooking time to substantially purge the cooking compartment of steam; and a heater configured to heat the cooking chamber during a cooking process and wherein the controller is further configured to disable the heater substantially simultaneously with the expiration of the cooking time.

22. The system of claim 21 further comprising a water supply configured to inject water into the cooking compartment during a cooking process and wherein the controller is further configured to control the water supply to cease injecting water into the cooking compartment at least one of prior to exposing the purge passage and substantially simultaneously with exposing the purge passage.

23. The system of claim 21 further comprising an alarm configured to provide at least one of a visual and an audio alarm upon exposing the purge passage.

24. The system of claim 21 further comprising a heater configured to heat the cooking chamber during a cooking process and wherein the controller is further configured to disable the heater substantially simultaneously with exposing the purge passage.

25. The system of claim 21 further comprising a push button configured to allow the cover to be manually moved.

26. A system for reducing a steam discharge from an oven comprising:

a cooking compartment arranged within the oven;

a purge passage extending through the oven into the cooking compartment;

a cover arranged to removeably block the purge passage;

a controller configured to receive a cooking time and automatically move the cover to expose the purge passage prior to expiration of the cooking time to substantially purge the cooking compartment of steam; and a push button configured to allow the cover to be manually moved.

27. The system of claim 26 further comprising a water supply configured to inject water into the cooking compartment during a cooking process and wherein the controller is further configured to control the water supply to cease injecting water into the cooking compartment at least one of prior to exposing the purge passage and substantially simultaneously with exposing the purge passage.

28. A method of operating an oven having an oven door comprising:

setting a user-selected cooking time;

automatically opening a purge passage formed in the oven to induce air external from the oven to enter the oven and substantially purge the oven of steam prior to the expiration of the user-selected cooking time; and providing at least one of an auditory and a visual alert substantially simultaneously with opening the purge passage.

* * * * *

UNITED STATES PATENT AND TRADEMARK OFFICE

CERTIFICATE OF CORRECTION

PATENT NO. : 7,282,674 B2
APPLICATION NO. : 11/356888
DATED : October 16, 2007
INVENTOR(S) : William J. Hansen It is certified that error appears in the above-identified patent and that said Letters Patent is hereby corrected as shown below:

Column 2, Line 47:
"114" should be
--14--

Signed and Sealed this

Twenty-fifth Day of December, 2007

JON W. DUDAS
*Director of the United States Patent and Trademark Office*